US008215508B2

(12) United States Patent
Baird et al.

(10) Patent No.: US 8,215,508 B2
(45) Date of Patent: Jul. 10, 2012

(54) CENTRIFUGE BOTTLE CLOSURE AND ASSEMBLY THEREOF

(75) Inventors: Peter Kevin Baird, Honeoye Falls, NY (US); John David DeLorme, Spencerport, NY (US); Keith Owen Whittlinger, Penfield, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 922 days.

(21) Appl. No.: 12/195,671

(22) Filed: Aug. 21, 2008

(65) Prior Publication Data

US 2009/0054221 A1 Feb. 26, 2009

Related U.S. Application Data

(60) Provisional application No. 60/965,647, filed on Aug. 21, 2007.

(51) Int. Cl.
*B65D 45/00* (2006.01)
*B65D 41/04* (2006.01)

(52) U.S. Cl. ..... 215/276; 220/288

(58) Field of Classification Search ..... 215/276, 215/274, 273, 44, 316, 200; 494/16, 12; D9/452; 220/200; *B65D 45/00, 41/02*
See application file for complete search history.

(56) References Cited

U.S. PATENT DOCUMENTS 3,071,316 A 1/1963 Piemonte et al.
3,110,411 A * 11/1963 Golde ..... 215/329
3,265,296 A * 8/1966 Mitchell ..... 494/16
3,330,433 A 7/1967 Salminen
3,335,923 A * 8/1967 Healy ..... 222/542
3,366,320 A * 1/1968 Cho ..... 494/16
3,434,615 A 3/1969 Barletta
3,491,908 A * 1/1970 Beimers ..... 215/276
3,582,535 A * 6/1971 Appleton ..... 174/562
4,098,419 A * 7/1978 Virog et al. ..... 215/252
4,383,620 A * 5/1983 Mumford ..... 215/329

(Continued)

FOREIGN PATENT DOCUMENTS

GB 2087851 A * 6/1982

(Continued)

OTHER PUBLICATIONS

International Searching Authority—International Search Report and Written Opinion, International Application No. PCT/US 08/73859, mailed Nov. 17, 2008, 9pp.

(Continued)

*Primary Examiner* — Mickey Yu
*Assistant Examiner* — Robert J Hicks
(74) *Attorney, Agent, or Firm* — Wood, Herron & Evans, LLP

(57) ABSTRACT

A closure for attachment to a centrifuge bottle. The closure comprises an end wall and a sidewall extending from the end wall. The sidewall comprises a first terminal end, a second terminal end, a first transition surface, and a second transition surface. The first terminal end has a first outer peripheral boundary at a first radial distance from an axial centerline. The second terminal end has a second outer peripheral boundary at a second radial distance from the axial centerline. The second radial distance is less than the first radial distance. The first transition surface extends between the first outer peripheral boundary and the second transition surface. The second transition surface extends between the first transition surface and the second outer peripheral boundary.

18 Claims, 6 Drawing Sheets

U.S. PATENT DOCUMENTS

| | | | | |
|---|---|---|---|---|
| 4,809,858 | A * | 3/1989 | Ochs | 215/276 |
| 5,823,373 | A | 10/1998 | Sudo et al. | |
| 5,931,323 | A * | 8/1999 | Wilkinson et al. | 215/228 |
| 6,062,407 | A | 5/2000 | Moore | |
| 6,350,225 | B1 | 2/2002 | Sheeran et al. | |
| 2002/0085957 | A1 | 7/2002 | Moore et al. | |
| 2003/0000909 | A1 * | 1/2003 | Sakaguchi et al. | 215/44 |
| 2003/0150833 | A1 * | 8/2003 | Shenkar | 215/252 |
| 2004/0108294 | A1 | 6/2004 | Bloom et al. | |

FOREIGN PATENT DOCUMENTS

| | | |
|---|---|---|
| JP | 57-177554 | 11/1982 |
| JP | 58-76154 | 5/1983 |
| JP | 5-501673 | 4/1993 |
| JP | 06-130730 | 5/1994 |
| JP | 7-507722 | 8/1995 |
| JP | 2002-517160 | 6/2002 |
| JP | 2004-290746 | 10/2004 |

OTHER PUBLICATIONS

European Patent Office, Supplementary European Search Report and Written Opinion, European Application No. 08798366.4, dated May 6, 2011 (6 pages).

Japanese Patent Office, First Office Action in Japanese Patent Application No. 2010-522024, dated Mar. 21, 2012.

European Patent Office; First Office Action in European Patent Application No. 08798366.4 dated Feb. 3, 2012; 3 pages.

* cited by examiner

CENTRIFUGE BOTTLE CLOSURE AND ASSEMBLY THEREOF

CROSS-REFERENCE TO RELATED APPLICATIONS

This application claims the filing benefit of co-pending U.S. Provisional Application No. 60/965,647, filed Aug. 21, 2007, the disclosure of which is incorporated by reference herein in its entirety.

TECHNICAL FIELD

The present invention relates to closures for centrifuge bottles, and assemblies thereof, for improved capacity and performance in centrifuges.

BACKGROUND

Bio-processing applications frequently require centrifugation to separate liquids containing biological materials, mixtures, or solutions such as, by way of example and not limitation, those produced by fermentation, in cell-growth chambers, reagent mixtures or other biological processing mechanisms. Centrifuge rotors with the capacity to hold large sample containers or bottles have been developed that can withstand rotational forces of above 15,000 times gravity, relative centrifugal force (RCF). Examples of large capacity rotors are FIBERLite™ rotors F6-6x 1000y and F6 4x100y (FIBERLite™ Piramoon Technologies Inc., Santa Clara, Calif.). Several bottles are commercially available for use with large capacity rotors but many, such as the Hitachi centrifuge bottle, have a maximum capacity of only about 920 ml, despite being referred to as a one-liter bottle.

One problem with developing true one-liter or larger bottles for these types of rotors has been that the fixed well diameters of the rotors limits the diameters of the bottles, and the fixed depths of the wells limits the heights of the bottles that can be received in the wells. Bottle diameters are typically designed to fit closely within the well of a rotor, although usually not tight. The heights of centrifuge bottles are generally such that the closure ends of the bottles touch, or nearly touch, at the focal point of the rotor.

To increase the heights of the bottles, one might reduce the amount of space allowance required for the closures to fit within the rotor. This reduction might be accomplished by reducing the overall thickness of the walls of the closure. However, thin closures are more susceptible to fail under the extreme g-forces encountered during centrifugation. Other conventional bottles have been modified to have larger capacity by, for example, sacrificing features that aid removal of the bottle from the rotor. To remove these types of bottles from the rotor, a separate tool may be required. Thus, loss of the tool may impede utilization of these modified bottles. A need therefore exists for large volume centrifuge bottles with closures that maximize the capacity thereof while providing reliable closure of the bottles.

SUMMARY

The present invention overcomes the foregoing and other shortcomings and drawbacks of centrifuge bottles heretofore known for use in processing materials in centrifuges. While the invention will be described in connection with certain embodiments, it will be understood that the invention is not limited to these embodiments. On the contrary, the invention includes all alternatives, modifications and equivalents as may be included within the scope of the present invention.

In one embodiment, the present disclosure describes a closure for attachment to a centrifuge bottle. The closure comprises an end wall and a sidewall having an axial centerline and extending from the end wall. The sidewall comprises a first terminal end opposite the end wall, a second terminal end adjacent the end wall, a first transition surface, and a second transition surface. The first terminal end has a first outer peripheral boundary at a first radial distance from the axial centerline. The first terminal end defines an opening for coupling the closure to the bottle. The second terminal end has a second outer peripheral boundary at a second radial distance from the axial centerline. The second radial distance is less than the first radial distance. The first transition surface extends between the first outer peripheral boundary and the second transition surface. The second transition surface extends between the first transition surface and the second outer peripheral boundary.

In another embodiment, an assembly comprises a centrifuge bottle having an internal volume of at least 1000 ml, and a closure adapted to be secured to the centrifuge bottle. The closure comprises an end wall and a sidewall having an axial centerline and extending from the end wall. The sidewall comprises a first terminal end opposite the end wall, a second terminal end adjacent the end wall, a first transition surface, and a second transition surface. The first terminal end has a first outer peripheral boundary at a first radial distance from the axial centerline and defines an opening for coupling the closure to the bottle. The second terminal end has a second outer peripheral boundary at a second radial distance from the axial centerline. The second radial distance is less than the first radial distance. The first transition surface extends between the first outer peripheral boundary and the second transition surface. The second transition surface extends between the first transition surface and the second outer peripheral boundary. The assembly is adapted for placement with other assemblies into a centrifuge such that the assemblies seat within a rotor of the centrifuge without interference contact between adjacent assemblies.

BRIEF DESCRIPTION OF THE FIGURES

The accompanying drawings, which are incorporated in and constitute a part of this specification, illustrate exemplary embodiments of the invention and, together with a general description given above, and the detailed description given below, serve to explain the invention in sufficient detail to enable one of ordinary skill in the art to which the invention pertains to make and use the invention.

DETAILED DESCRIPTION

Figure 1:
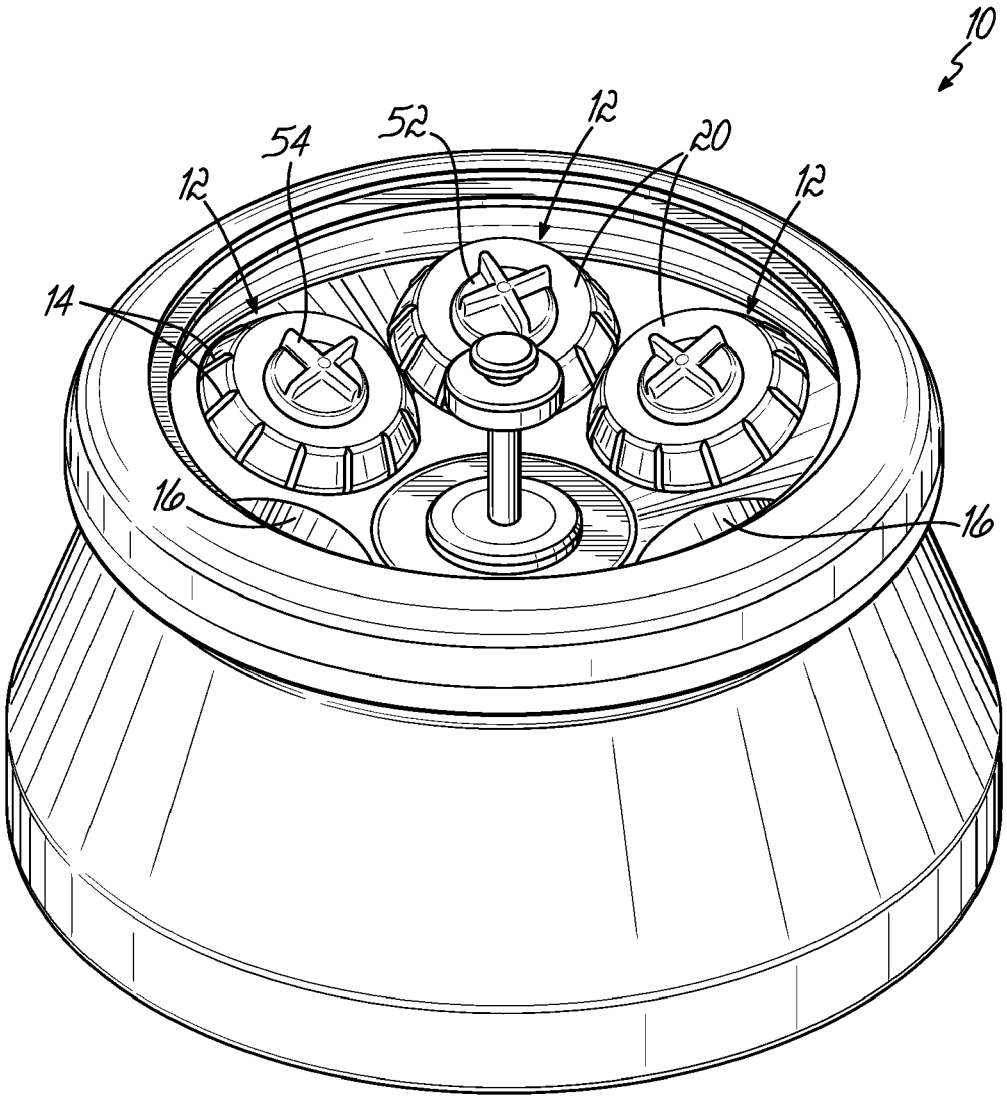
FIG. 1 is a perspective view of an exemplary centrifuge rotor and exemplary centrifuge bottles in accordance with the present disclosure.
Figure 2:
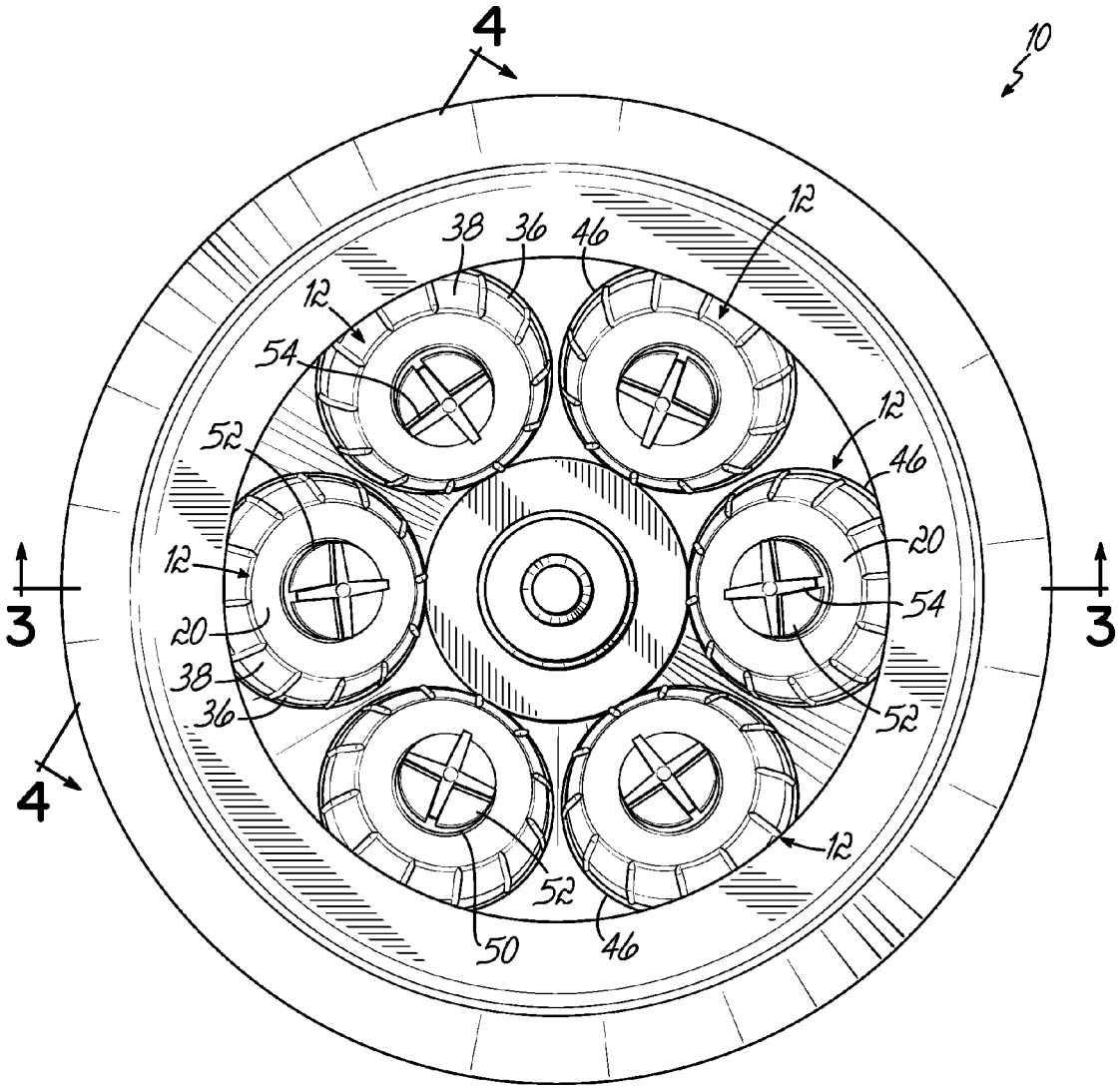
FIG. 2 is a top plan view of the rotor of FIG. 1, depicting six centrifuge bottles supported thereon.

Referring to FIGS. 1 and 2, a centrifuge rotor 10 is shown supporting a plurality of centrifuge bottles 14, each centrifuge bottle 14 including an exemplary closure 12 in accordance with the present disclosure. As is known in the art, the centrifuge rotor 10 fits within a centrifuge housing (not shown). Centrifuges are used to separate substances having different densities from one another by applying forces that far exceed gravitational forces to the substances. These substances may be placed into the centrifuge bottle 14 and contained within the bottle 14 by closure 12. The assembly of the closure 12 and bottle 14 that is filled with material is placed into the rotor 10. The rotor 10 is then placed within a centrifuge housing and is rotated within the centrifuge housing. The forces generated by the rotating rotor may exceed 15,000 times that of gravity. As is best illustrated in FIG. 2, a plurality of assembled centrifuge bottles 14 and closures 12, as described herein, may be individually placed within a well 16 (shown empty in FIG. 1) of the centrifuge rotor 10. While embodiments of the closure 12 are described with respect to one configuration of a centrifuge rotor, one skilled in the art will appreciate that principles disclosed herein are equally applicable to other configurations of centrifuge rotors (for example, fixed angle rotors, swing bucket rotors, or others). Exemplary fixed angle rotors include the FIBERLite™ rotors, such as the F6-6x1000y or F6-4x100y, available from Piramoon Technologies Inc., Santa Clara, Calif.

Figure 3:
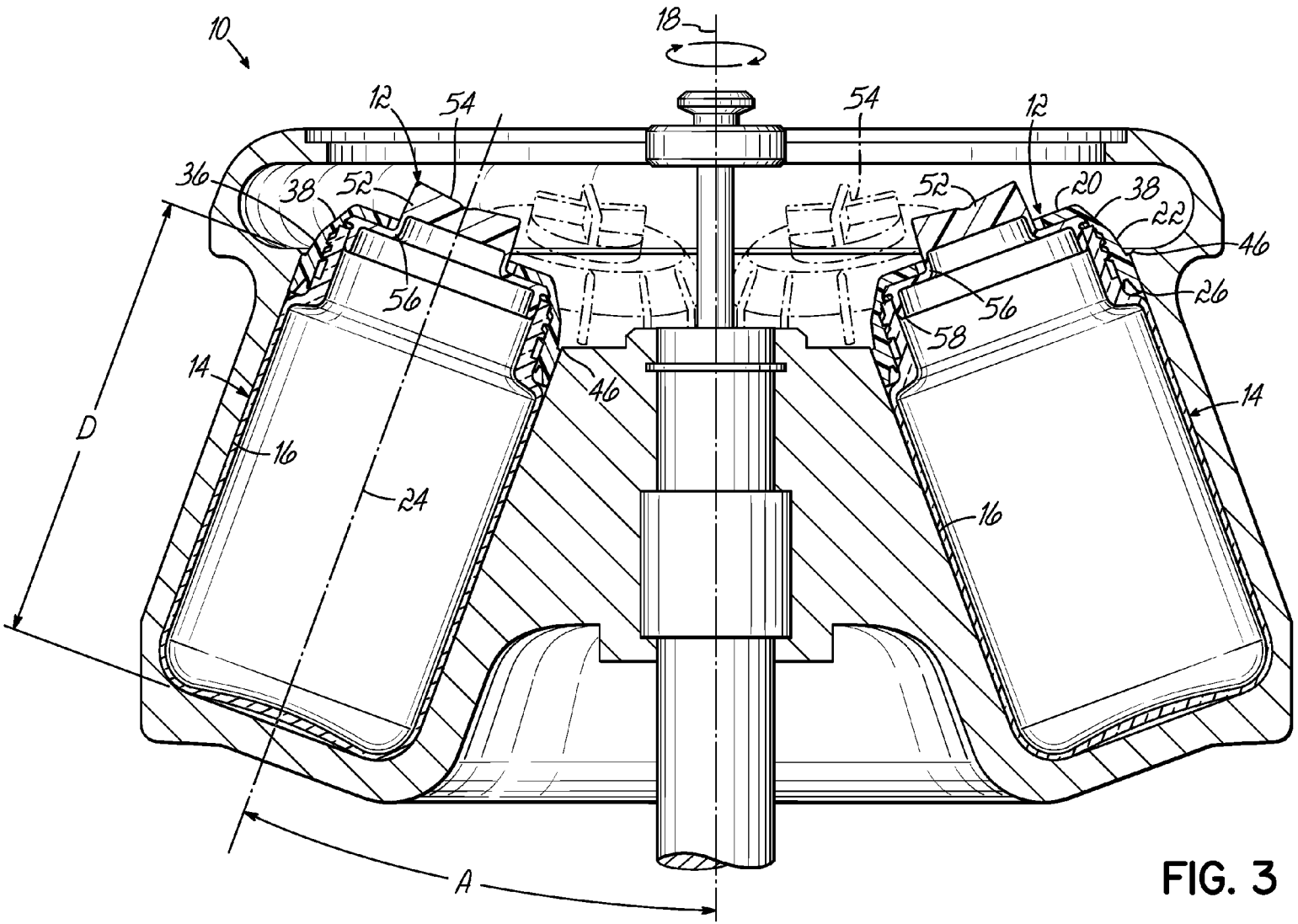
FIG. 3 is a cross-sectional view taken along section line 3-3 of FIG. 2.

FIG. 3 illustrates one exemplary embodiment of assembled centrifuge bottles 14 and closures 12 residing within the centrifuge rotor 10. As shown, the assembled centrifuge bottles 14 and closures 12 fit within the rotor wells 16 such that they are inclined at an angle (A) relative to a rotor axis 18. Consequently, for a given rotor, the interior diameters of the rotor wells 16 limits the maximum diameters of the centrifuge bottles. Furthermore, as shown in FIG. 3, the depth (D) of the rotor well 16 and the angle of inclination (A) of the rotor well 16 to the rotor axis 18 limits the heights of the centrifuge bottles 14. Specifically, as depicted by phantom lines in FIGS. 4 and 4A, the height of the bottles with conventional closure 19 having generally straight sidewalls is limited by interference between adjacent bottles 14. Ultimately, the degree of interference between closures 19 may prevent the full capacity of the rotor 10 from being utilized. For example, it may be that bottles can only be placed in every other well, to avoid interference between adjacent closures 19 when large bottles are used. Such an arrangement does not utilize the full capacity of the rotor 10.

Figure 4:
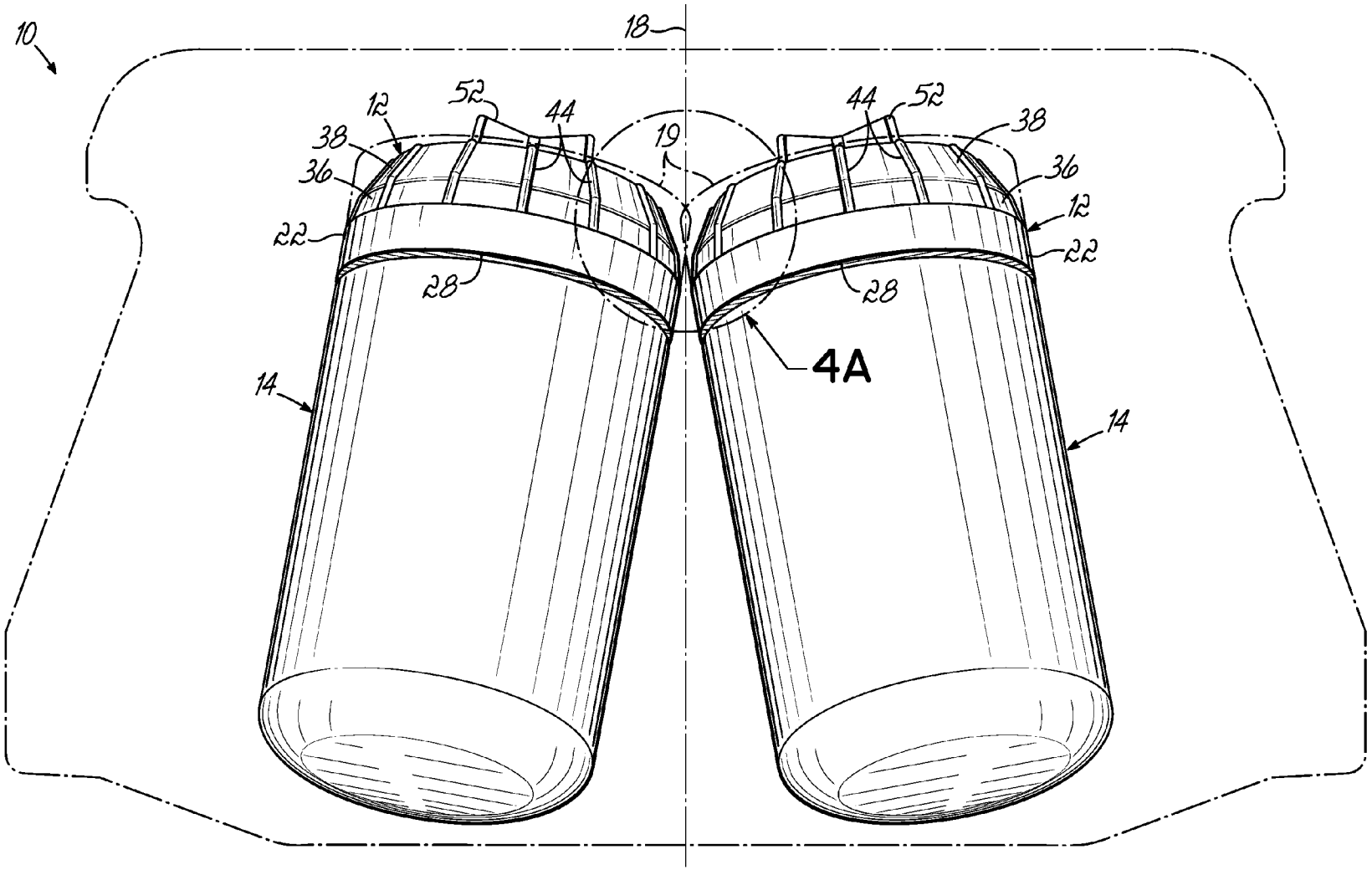
FIG. 4 is a cross-sectional view taken along section line 4-4 of FIG. 2.
Figure 4A:
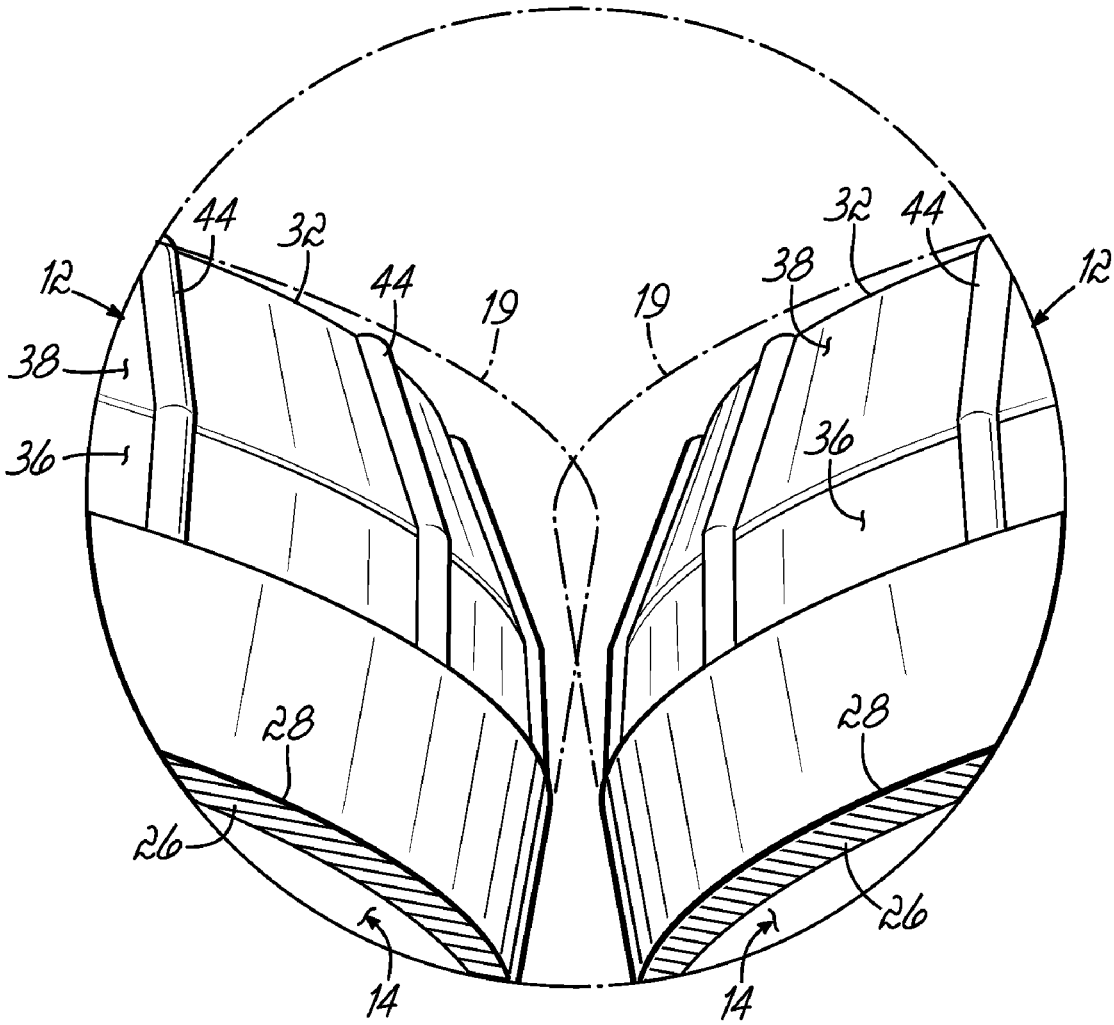
FIG. 4A is an enlarged view of the encircled area 4A of FIG. 4.

The interference that limits the height of the bottle 14 is best depicted by the phantom lines in FIGS. 4 and 4A. The inclination of the centrifuge bottles 14 toward the rotor axis 18 (shown in FIG. 3) causes the adjacent, assembled bottles 14 and prior art caps 19 to converge toward one another near the rotor axis 18. Once the centrifuge bottles 14 exceed a certain height, caps 19 shaped according to the phantom lines in FIGS. 4 and 4A interfere with one another. The interference is best illustrated in FIG. 4A by the overlap of the phantom lines. Thus, for a given rotor, interference between adjacent caps 19 limits the height of the centrifuge bottle 14 and, therefore, limits the fluid volume capacity of the rotor 10. Closures 12, as described herein, allow additional fluid volume capacity to be added to the centrifuge bottles by utilizing currently unused space near the rotor axis 18, as shown in FIGS. 4 and 4A, while avoiding interference between adjacent closures 12. Thus, by way of example and not limitation, a centrifuge bottle having a fluid capacity of one liter or more may be utilized where previous so-called one-liter bottles would either not fit within a rotor or would not hold a full one-liter fluid volume.

In one embodiment, and with continued reference to FIGS. 4 and 4A, the centrifuge bottle 14 has a volume of least one liter. A one-liter capacity bottle 14 assembled with the closure 12 may be inserted with similar bottles 14 and closures 12 into the rotor 10 without interference between adjacent closures 12. Thus, in contrast with prior art caps 19 and bottles 14, which are limited to about 920 ml capacity, the total process volume of, for example, an F6-6x1000y rotor loaded with six one-liter bottles 14 with closures 12, as described herein, is at least 6 liters. For this rotor design, the capacity-per-cycle increases over the prior art by at least about 480 ml, or at least about 9%. Thus, compared to use of prior art bottles and caps, substantial time and money savings are realized due to the reduced number of centrifugation runs necessary.

Figure 5:
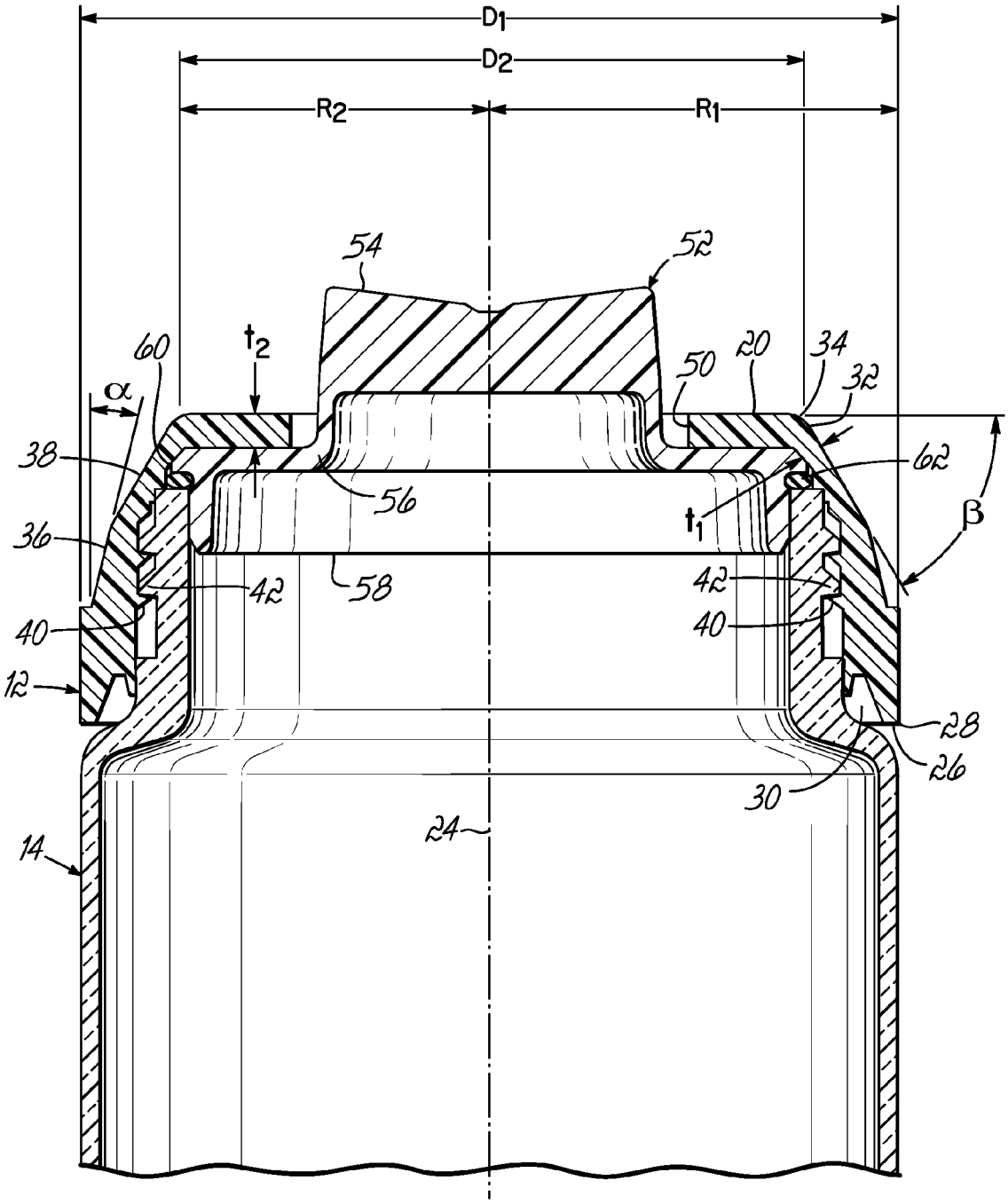
FIG. 5 is a cross-sectional view of one embodiment of a closure secured to a centrifuge bottle.

One exemplary embodiment of the closure 12 secured to a bottle 14 is shown in FIG. 5. The closure 12 comprises an end wall 20 and a sidewall 22. The sidewall 22 has an axial centerline 24 and extends from the end wall 20. The sidewall 22 comprises a first terminal end 26 opposite the end wall 20. The first terminal end 26 has a first outer peripheral boundary 28 at a first radial distance R1 from the axial centerline 24. The first terminal end 26 defines an opening 30 for coupling the closure 12 to the bottle 14.

With continued reference to FIG. 5, the closure 12 has a second terminal end 32 adjacent the end wall 20. The second terminal end 32 has a second outer peripheral boundary 34, at least a portion of which is at a second radial distance R2 from the axial centerline 24. The second radial distance R2 is less than the first radial distance R1. In one embodiment, the first radial distance R1 may be about 1.93 inches, the second radial distance R2 may be about 1.47 inches, the distance from the first terminal end 26 to the second terminal end 32 may be about 1.4 inches, the thickness (t1) of the closure 12 near the end wall 20 may be about 0.1 inches, and the thickness (t2) of the end wall 20 may be about 0.16 inches. It will be appreciated, however, that these dimensions may vary depending upon other features of the closure 12 described below.

In addition, with reference to FIG. 5, the sidewall 22 has at least a first transition surface 36 and a second transition surface 38. The first transition surface 36 extends between the first outer peripheral boundary 28 and the second transition surface 38, and the second transition surface 38 extends between the first transition surface 36 and the second outer peripheral boundary 34. In another embodiment, additional transition surfaces may extend between the first and second transition surfaces 36, 38. For example, a third transition surface (not shown) may extend between the first and the second transition surface 36, 38. While the sidewall 22 may have additional transition surfaces, as the number of transition surfaces increases, the relative improvement in the closure 12 decreases. Therefore, an infinite number of transition surfaces, that is, a single curved surface or arc extending between the first outer peripheral boundary 28 and the second outer peripheral boundary 34, is not as efficient as, for example, two transition surfaces. In particular, an arc increases the height of the closure and results in a reduced thickness of the closure near the threads. The reduced thickness near the threads reduces the strength of the closure. To improve the strength, the threads must be moved in a direction that reduces the bottle height. Thus, the overall effect of an arc is a reduction in the volume of the bottle. By comparison, a closure with two transition surfaces has sufficient strength while maximizing the volume of the bottle.

As shown in FIG. 5, in one embodiment, the first and second transition surfaces 36, 38 each have a linear cross section when taken along a plane through the axial centerline 24. The first transition surface 36 is oriented at a first angle $\alpha$, measured from a line parallel to the axial centerline 24. The second transition surface 38 is at a second angle $\beta$, measured from a plane oriented perpendicular to the axial centerline 24. In one embodiment, the first angle α is about 9° to about 15°, and the second angle β is about 55° to about 65°. In another embodiment, the first angle α is about 12° and the second angle β is about 60°. The inventors have discovered that a closure 12 with at least two transition surfaces 36, 38 having the specified angular relationship, described above, resists distortion due to the high acceleration loads exerted on the closure 12 during rotation in a centrifuge while allowing the centrifuge bottle 14 to be increased in height relative to caps of the prior art. For example, a closure 12 made of a blend of polyphenylene ether and high impact polystyrene (HIPS), as described above, was attached to one-liter bottles 14 made of either polypropylene or polycarbonate. The bottle 14 was filled to capacity with a liquid having a specific gravity of about 1.2. This assembly was then placed into a rotor and subsequently into a centrifuge housing. During centrifugation testing, the closure 12 resisted forces of at least 15,800 times that of gravity without bursting, breaking, or leaking.

With continued reference to FIG. 5, in one embodiment, the first outer peripheral boundary 28 is defined by a first diameter D1 and the second outer peripheral boundary 34 is defined by a second diameter D2. The second diameter D2 is smaller than the first diameter D1. In other words, the second terminal end 32 has a reduced diameter compared to the first terminal end 26. In this embodiment, the first and second transition surfaces 36, 38 extend circumferentially around the sidewall 22 as shown in FIG. 2. While the figures illustrate the closure 12 having a substantially radially symmetrical shape, that is, the first and second outer peripheral boundaries 28, 34 are circular, the principles disclosed herein are not limited to this configuration. For example, the first outer peripheral boundary 28 may be circular while the second outer peripheral boundary 34 may be only partially circular, with a portion defined by the second radial distance R2 of less than one-half of the first diameter D1. The first transition surface 36 may then extend from the first outer peripheral boundary 28 to the second transition surface 38, and the second transition surface 38 may extend from the first transition surface 36 to the portion of the second outer peripheral boundary 34 that is at the second radial distance R2 from the axial centerline 24. Thus, the first and second transition surfaces 36, 38 may be formed along limited regions of the sidewall 22. When properly oriented, adjacent closures 12 with similarly positioned transition surfaces 36, 38 do not interfere with each other.

In one embodiment, as shown in FIG. 5, the sidewall 22 has a plurality of threads 40 within the opening 30 for threaded engagement with threads 42 on the centrifuge bottle 14. However, one skilled in the art will observe and appreciate that other methods or structure, such as friction fit, bayonet attachment, or others, for securing the closure 12 to the centrifugal bottle 14 may alternatively be utilized in accordance with the present disclosure.

As depicted in FIGS. 1 and 2 and shown best in FIG. 4A, in one embodiment, a plurality of ribs 44 are positioned along the sidewall 22. While providing a surface feature to facilitate gripping the closure 12 to ease attachment and removal of the closure 12 from the centrifuge bottle 14, the ribs 44 may also improve resistance to deformation of the closure 12 under the high acceleration loads during centrifugation.

In one embodiment, as shown in FIG. 3, a portion of the sidewall 22 at the first radial distance R1 (labeled in FIG. 5) from the axial centerline 24 extends from the first terminal end 26 to a height of approximately an edge 46 of the rotor well 16. This configuration provides an area of contact between the sidewall 22 and the rotor 10 that supports the closure 12 and centrifuge bottle 14 when subject to rotational forces during use.

While the closure 12 has been shown and described herein as having a generally circular-shaped sidewall 22, it will be appreciated that the sidewall may alternatively be formed in various other shapes.

By way of example, and not limitation, the closure 12 may be molded or otherwise made of an unfilled or filled blend of polyphenylene ether and high impact polystyrene (HIPS), polypropylene (either unfilled or glass-filled), polyphenylene sulfide, polyphenylenesulfone, polyether sulfone, polysulfone, polyetheretherketone, polyphenylene oxide (preferably glass-filled, such as Noryl GFN2, available from Saudi Basic Industries Corporation), polyetherimide (unfilled or glass-filled), acetal copolymer or homopolymer (unfilled and filled), cellulose acetate (with plasticizer), cellulose acetate butyrate (with plasticizer), thermoplastic polyurethane (unfilled and filled), polyamides (unfilled and filled), or acrylonitrile butadiene styrene (ABS) (unfilled and filled). By way of example and not limitation, the bottle 14 may be molded from polypropylene, polycarbonate, polymethylpentene, acrylic or acrylic blends, polyethyleneterephthlate (PET), glycol-modified PET copolyester (PETG), cyclic olefin (co)polymers, polysulfone, polystyrene or polystyrene blends, polyaryl sulfones, or ABS.

In another embodiment, shown in FIG. 5, the end wall 20 has an aperture 50 formed therein such that a plug 52 may be removably received in the aperture 50. Alternatively, the plug 52 may be formed integral with the closure 12. The plug 52 has grip ridges 54 in a cross-shaped pattern (illustrated best in FIG. 2) to ease insertion and removal of the plug 52 within the aperture 50. As shown in FIG. 5, the plug 52 comprises a body 56 with a circumferential flange 58 that projects from the body 56 in a direction parallel to the axial centerline 24 of the sidewall 22 of the closure 12. The circumferential flange 58 is sized to be received within with the interior of the bottle 14. A rim 60 of the body 56 extends radially outward beyond the circumferential flange 58. A seal 62, such as an o-ring or other pliable sealing structure, may be captured between the rim 60 of the body 56 and the centrifuge bottle 14 to seal substances within the bottle 14. Alternately, a seal between closure components and centrifuge bottle can be accomplished by methods such as multi-shot molding with a pliable sealing structure. It will be appreciated that rotation of the closure 12 to secure it to the bottle 14 does not cause substantial rotation of the plug 52. Since the plug 52 does not substantially rotate, its movement is primarily parallel to the axial centerline 24 such that the seal 62 is axially compressed between the rim 60 and the lip of the bottle 14. Accordingly, closure 12 may be rotated or otherwise secured to the centrifuge bottle 14 without binding, twisting, or otherwise damaging the seal 62.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A closure for attachment to a centrifuge bottle having a mouth, the closure having a thread for threaded engagement with the centrifuge bottle and comprising:

an end wall; and a sidewall having an axial centerline and extending from said end wall, said sidewall comprising:

a first terminal end opposite said end wall, said first terminal end having a first outer peripheral boundary at a first radial distance from said axial centerline;

said first terminal end defining an opening for coupling the closure to the bottle;

a second terminal end adjacent said end wall, said second terminal end having a second outer peripheral boundary at a second radial distance from said axial centerline, said second radial distance being less than said first radial distance;

a first transition surface inclined at an angle relative to said axial centerline with said thread being positioned radially inwardly from said first transition surface; and a second transition surface inclined at an angle relative to said axial centerline, said second transition surface being configured to intersect a plane defined by the mouth of said centrifuge bottle when the closure is attached to the mouth;

said first transition surface extending between said first outer peripheral boundary and said second transition surface;

said second transition surface extending between said first transition surface and said second outer peripheral boundary.

2. The closure of claim 1, wherein said first transition surface and said second transition surface each have a linear cross section when taken along a plane through said axial centerline.

3. The closure of claim 2, wherein said first transition surface is oriented at a first angle, measured from a line parallel to said axial centerline, of between about 9° and about 15°, and said second transition surface is oriented at a second angle, measured from a plane perpendicular to said axial centerline, of between about 55° and about 65°.

4. The closure of claim 3, wherein said first angle is about 12° and said second angle is about 60°.

5. The closure of claim 1, wherein said first outer peripheral boundary is defined by a first diameter, said second outer peripheral boundary is defined by a second diameter smaller than said first diameter, and said first and second transition surfaces extend circumferentially around said sidewall.

6. The closure of claim 1, wherein said sidewall further comprises a plurality of threads adapted for threaded engagement with the centrifuge bottle.

7. The closure of claim 1, wherein said end wall and said sidewall are made from a material selected from a group consisting of an unfilled or filled blend of polyphenylene ether and high impact polystyrene, unfilled or glass-filled polypropylene, polyphenylene sulfide, polyphenylene-sulfone, polyether sulfone, polysulfone, polyetheretherketone, unfilled or filled polyphenylene oxide, unfilled or glass-filled polyetherimide, unfilled or filled acetal copolymer or homopolymer, cellulose acetate, cellulose acetate butyrate, unfilled or filled thermoplastic polyurethane, unfilled or filled polyamides, and unfilled or filled ABS.

8. A closure for attachment to a centrifuge bottle having a mouth, the closure having a thread for threaded engagement with the centrifuge bottle and comprising:

an end wall having an aperture formed therein; and a sidewall having an axial centerline and extending from said end wall, said sidewall comprising:

a first terminal end opposite said end wall, said first terminal end having a first outer peripheral boundary at a first radial distance from said axial centerline;

said first terminal end defining an opening for coupling the closure to the bottle;

a second terminal end adjacent said end wall, said second terminal end having a second outer peripheral boundary at a second radial distance from said axial centerline, said second radial distance being less than said first radial distance;

a first transition surface inclined at an angle relative to said axial centerline with said thread being positioned radially inwardly from said first transition surface; and a second transition surface inclined at an angle relative to said axial centerline, said second transition surface being configured to intersect a plane defined by the mouth of said centrifuge bottle when the closure is attached to the mouth;

said first transition surface extending between said first outer peripheral boundary and said second transition surface;

said second transition surface extending between said first transition surface and said second outer peripheral boundary.

9. The closure of claim 8, further comprising:

a plug removably received in said aperture, said plug having grip ridges in a cross-shaped pattern to ease insertion and removal of said plug within said aperture.

10. An assembly comprising:

a centrifuge bottle having a mouth and an internal volume of at least 1000 ml; and a closure having a thread for threaded engagement with said centrifuge bottle and being removably secured to said centrifuge bottle, said closure comprising:

an end wall; and a sidewall having an axial centerline and extending from said end wall, said sidewall comprising:

a first terminal end opposite said end wall, said first terminal end having a first outer peripheral boundary at a first radial distance from said axial centerline;

said first terminal end defining an opening for coupling the closure to the bottle;

a second terminal end adjacent said end wall, said second terminal end having a second outer peripheral boundary at a second radial distance from said axial centerline, said second radial distance being less than said first radial distance;

a first transition surface inclined at an angle relative to said axial centerline with said thread being positioned radially inwardly from said first transition surface; and a second transition surface inclined at an angle relative to said axial centerline, said second transition surface being configured to intersect a plane defined by the mouth of said centrifuge bottle when the closure is attached to said mouth;

said first transition surface extending between said first outer peripheral boundary and said second transition surface;

said second transition surface extending between said first transition surface and said second outer peripheral boundary, whereby the assembly is adapted for placement with other assemblies into a centrifuge rotor such that the assemblies seat within the centrifuge rotor without interference contact between adjacent assemblies.

11. The assembly of claim 10, wherein said first transition surface and said second transition surface each have a linear cross section when taken along a plane through said axial centerline.

12. The assembly of claim 11, wherein said first transition surface is oriented at a first angle, measured from a line parallel to said axial centerline, of between about 9° and about 15°, and said second transition surface is oriented at a second angle, measured from a plane perpendicular to said axial centerline, of between about 55° and about 65°.

13. The assembly of claim 12, wherein said first angle is about 12° and said second angle is about 60°.

14. The assembly of claim 10, wherein said first outer peripheral boundary is defined by a first diameter, said second outer peripheral boundary is defined by a second diameter smaller than said first diameter, and said first and second transition surfaces extend circumferentially around said sidewall.

15. The assembly of claim 10, wherein said end wall has an aperture formed therein.

16. The assembly of claim 15, further comprising:

a plug removably received in said aperture, said plug having grip ridges in a cross-shaped pattern to ease insertion and removal of said plug within said aperture.

17. The assembly of claim 10, wherein said sidewall further comprises a plurality of threads adapted for threaded engagement with said centrifuge bottle.

18. The assembly of claim 10, wherein said end wall and said sidewall are made from a material selected from a group consisting of an unfilled or filled blend of polyphenylene ether and high impact polystyrene, unfilled or glass-filled polypropylene, polyphenylene sulfide, polyphenylenesulfone, polyether sulfone, polysulfone, polyetheretherketone, polyphenylene oxide, unfilled or glass-filled polyetherimide, unfilled or filled acetal copolymer or homopolymer, cellulose acetate, cellulose acetate butyrate, unfilled or filled thermoplastic polyurethane, unfilled or filled polyamides, and unfilled or filled ABS.

* * * * *